United States Patent [19]

Barbe et al.

[11] Patent Number: 4,503,867

[45] Date of Patent: Mar. 12, 1985

[54] APPARATUS FOR SEVERING A RUNNING WEB OF TIPPING PAPER OR THE LIKE

[75] Inventors: Karl-Heinz Barbe; Erich Berger, both of Hamburg, Fed. Rep. of Germany

[73] Assignee: Hauni-Werke Körber & Co. KG, Hamburg, Fed. Rep. of Germany

[21] Appl. No.: 421,562

[22] Filed: Sep. 22, 1982

[30] Foreign Application Priority Data

Jun. 1, 1982 [DE] Fed. Rep. of Germany ..... 3220580

[51] Int. Cl.[3] ..... A24C 5/56; B26D 1/36

[52] U.S. Cl. ..... 131/95; 83/677

[58] Field of Search ..... 131/94, 95; 83/677, 83/346, 347, 674, 337, 338

[56] References Cited

U.S. PATENT DOCUMENTS

| | | | |
|---|---|---|---|
| 1,730,006 | 10/1929 | Harrold | 83/677 |
| 2,660,242 | 11/1953 | Lane | 83/677 |
| 3,340,757 | 9/1967 | Rudszinat | 83/674 |
| 4,240,313 | 12/1980 | Gillespie | 83/346 |
| 4,370,908 | 2/1983 | DeAlto | 83/677 |

FOREIGN PATENT DOCUMENTS

| | | | |
|---|---|---|---|
| 3219046 | 12/1982 | Fed. Rep. of Germany | 131/95 |

*Primary Examiner*—V. Millin
*Assistant Examiner*—Harry Macey
*Attorney, Agent, or Firm*—Peter K. Kontler

[57] ABSTRACT

A running web of tipping paper in a filter tipping machine is attracted to the peripheral surface of a rotary suction conveyor constituting a counterknife for a set of equidistant knives which are radially movably mounted in axially parallel grooves of a rotary knife carrier. Each knife is adjustable radially of the carrier by a discrete first adjusting device, and all of the knives are adjustable simultaneously by a common adjusting device having a support movable axially of the carrier and mounting all of the first adjusting devices. Simultaneous radial adjustment of all of the knives by the common adjusting device is effected after certain periods of use and attendant wear upon the cutting edges of the knives.

17 Claims, 1 Drawing Figure

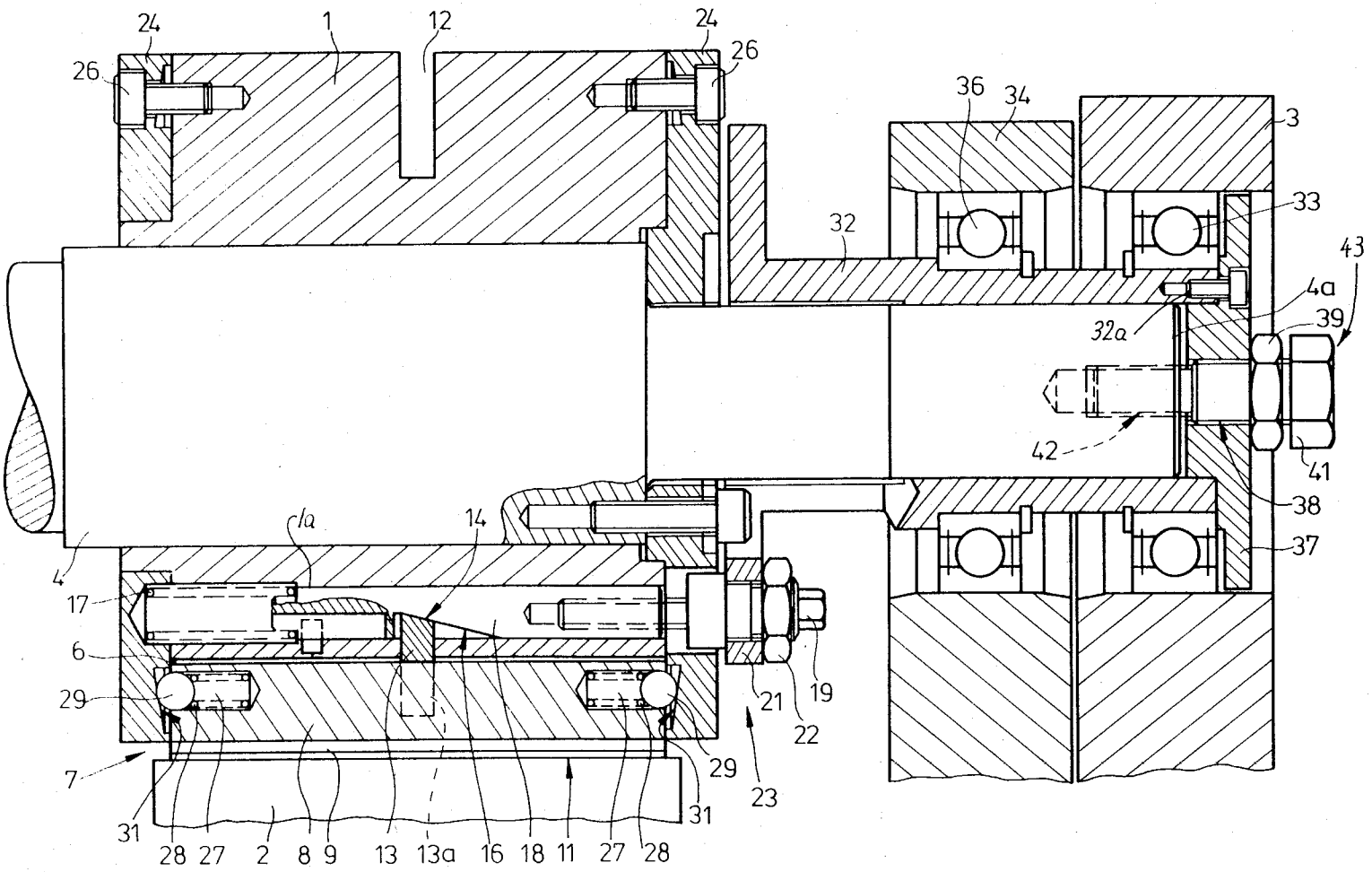
43
4a
39
41
38
37
3
33
32a
42
34
36
32
19
22
21
23
26
24
29
31
28
27
11
18
16
14
13a
13
12
1
1a
9
8
2
27
28
24
26
31
17
6
29
7
4

APPARATUS FOR SEVERING A RUNNING WEB OF TIPPING PAPER OR THE LIKE

BACKGROUND OF THE INVENTION

The present invention relates to improvements in apparatus for severing running webs of paper, imitation cork or the like. More particularly, the invention relates to improvements in apparatus which can be utilized, for example, in filter tipping machines to subdivide webs of cigarette paper, imitation cork or other types of tipping paper into discrete uniting bands. Such uniting bands can be utilized in filter tipping machines to connect plain cigarettes of unit length or multiple unit length with filter plugs or filter mouthpieces of unit length or multiple unit length. Still more particularly, the invention relates to improvements in severing or subdividing apparatus of the type wherein the web which is to be subdivided into discrete sections or uniting bands is caused to advance between a rotary counterknife or anvil and a rotary knife carrier which is provided with one or more adjustable knives serving to cut across the running web during travel toward and through the nip of the counterknife and the knife carrier.

As a rule, the rotary knife carrier of a severing apparatus for running webs of tipping paper or the like is provided with several axially parallel grooves for reception of knife holders which, in turn, support the blades whose cutting edges sever the running web while moving past the rotary counterknife. The knives and/or their holders are adjustable individually so as to ensure that the cutting edge of each knife will actually contact the peripheral surface of the rotary counterknife in the course of a cutting or severing operation. Such adjustability of the knives ensures that the cutting edges will form clean cuts all the way across the running web, namely, from the one to the other marginal portion of the web. Reference may be had to the commonly owned U.S. Pat. No. 3,340,757 granted Sept. 12, 1967 to Willy Rudszinat. The patented apparatus utilizes knives which are pitovable on axially movable wedge-like adjusting elements so that any axial displacement of the adjusting elements results in radial displacement of the knives with reference to the axis of the knife carrier. Adjustability of the knives is desirable for several reasons, namely, for the aforediscussed reason that the cutting edges of all knives should actually contact the peripheral surface of the counterknife upon completion of a cut and also because the wear upon the cutting edges is quite pronounced so that it is necessary to intermittently move the knives radially outwardly to compensate for wear upon their cutting edges. As a rule, an adjustment is necessary after a certain period of continuous use, for example, upon completion of each eight-hour shift. Such cutting apparatus operate quite satisfactorily except that the adjustment of each and every knife upon completion of a shift or after elapse of another interval takes up a substantial amount of time. Moreover, it is often necessary to resort to highly accurate and sensitive calibrating or testing apparatus which must ascertain the magnitude of force or pressure with which the cutting edges of the orbiting knives engage the peripheral surface of the counterknife.

OBJECTS AND SUMMARY OF THE INVENTION

An object of the invention is to provide a novel and improved apparatus for subdividing running webs of cigarette paper or the like into individual sections wherein the adjustment of knives after a certain period of use and the resulting wear upon the cutting edges can be completed within surprisingly short intervals of time.

Another object of the invention is to provide a cutting or severing apparatus wherein the knives are adjustable individually the same as in conventional apparatus, but are also adjustable jointly to ensure identical shifting of the cutting edges with reference to the knife carrier.

A further object of the invention is to provide novel and improved adjusting means for the knives in a cutting or severing apparatus of the above outlined character.

An additional object of the invention is to provide a machine, such as a filter tipping machine, which embodies the improved severing apparatus.

A further object of the invention is to provide a severing apparatus which can be utilized as a superior substitute for severing apparatus of the presently known design.

Still another object of the invention is to provide an apparatus which can reliably sever a running web of paper or the like and wherein the cutting implements can be adjusted within a fraction of the time which is required for such adjustment in a conventional severing apparatus.

A further object of the invention is to provide a severing apparatus which is more versatile, but need not be bulkier, than conventional severing apparatus.

The invention is embodied in an apparatus for subdividing a running web, especially a web or strip of tipping paper in a filter tipping machine, into discrete sections. The apparatus comprises a rotary knife carrier, a counterknife (preferably a rotor whose axis is spaced apart from the axis of the knife carrier) which is adjacent to and defines with the carrier a path for the running web substantially at right angles to the axis of the carrier, a plurality of adjustable knives on the carrier, a discrete first adjusting device for each knife (each such adjusting device comprises means for adjusting the respective knife substantially radially of the carrier), and an adjusting device which is common to all of the knives and includes means for simultaneously moving all of the knives substantially radially of the knife carrier.

The knife carrier is preferably provided with substantially radially extending (and preferably axially parallel) guide means in the form of grooves or the like, and each such guide means movably receives one of the knives.

The common adjusting device preferably comprises a support for all of the first adjusting devices, and such support can constitute a component of the means for simultaneously moving all of the knives.

Each of the first adjusting devices can comprise a knife-displacing member having a cam which engages the respective knife, and means for moving the displacing member in parallelism with the axis of the knife carrier to thereby move the respective knife radially of the carrier through the medium of the cam on the displacing member. The aforementioned support of the common adjusting device can carry all of the displacing members as well as the means for moving such displacing members in parallelism with the axis of the knife carrier. The means for moving the displacing members can comprise screws which are rotatably mounted in the support. The aforementioned cams can constitute substantially wedge-like portions of the displacing members, and such wedge-like portions can cooperate with pivots for the respective knives (the pivots enable the knives to tilt in their guide grooves in planes including the axis of the knife carrier).

The support preferably includes an annulus (e.g., a ring-shaped collar or flange) which is adjacent to one end face of the knife carrier. The common adjusting device preferably further comprises means for moving the support and the first adjusting devices axially of the knife carrier. To this end, the carrier can comprise a shaft which is surrounded by the aforementioned annulus and preferably also by a sleeve-like portion of the support. Such sleeve-like portion has an end portion which is remote from the annulus and extends beyond the shaft to carry a lid for an externally threaded rotary member constituting the means for moving the support axially of the knife carrier. The axis of the externally threaded member is parallel to the axis of the shaft, and the shank of this member has a first set of threads meshing with the shaft as well as a second set of threads meshing with the lid. The lead of one set of threads is different from the lead of the other set of threads so that, when the externally threaded member is rotated relative to the shaft, the support moves axially of the shaft and the knife carrier to thereby simultaneously displace all of the first adjusting devices and effect an appropriate adjustment of all of the knives radially of the knife carrier.

The apparatus can comprise one or more locating blocks which hold the carrier and the counterknife against movement relative to each other radially of the carrier.

The novel features which are considered as characteristic of the invention are set forth in particular in the appended claims. The improved severing apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary axial sectional view of a severing apparatus for running paper webs or the like which is constructed and assembled in accordance with the present invention.

DESCRIPTION OF THE PREFERRED EMBODIMENTS

The drawing illustrates a cutting or severing apparatus which comprises a rotary knife carrier 1 having a driven shaft 4 receiving torque from the main prime mover of a filter tipping machine, for example a machine of the type disclosed in commonly owned U.S. Pat. No. 4,193,409 granted Mar. 18, 1980 to Günter Wahle et al. The disclosure of this patent is incorporated herein by reference.

The severing apparatus further comprises a rotary counterknife 2 which can constitute a suction drum and is rotatable about an axis that is parallel with the axis of the shaft 4. With reference to the aforementioned patent, the counterknife 2 corresponds to the counterknife 19 of the patent, and the knife carrier 1 corresponds to the knife carrier 21 of this reference.

The knife carrier 1 and the counterknife 2 are mounted, at each of their axial ends, in the frame or housing 3 of a filter tipping machine. A portion of such frame is shown in the right-hand part of the drawing. Reference may also be had to German patent application Ser. No. P 32 19 046.8.

The knife carrier 1 is provided with axially parallel radially extending peripheral guide grooves 6 which are equally spaced from one another, as considered in the circumferential direction of the carrier 1. Each of the guide grooves 6 receives one of several adjustable knives 7 of which only one is actually shown in the drawing. The distribution of knives 7 about the shaft 4 may be similar to that shown in FIG. 1 of the aforementioned U.S. Pat. No. 3,340,757 to Rudszinat. Each of the knives 7 comprises a holder 8 and a pivotable cutting or severing blade 9 which is mounted in the respective holder 8 and has an elongated cutting edge 11 serving to sever the web (not shown) which advances between the carrier 1 and the counterknife 2 at right angles to the plane of the drawing. The peripheral surface of the counterknife 2 can be provided with suction ports (not shown) which are connected to a suction generating device so that the counterknife 2 attracts the leader of the web during travel through the nip of the rotary parts 1 and 2. Such mode of transporting the web toward, and of transporting the uniting bands or web sections beyond, the severing station is known in the art of filter tipping and analogous machines.

The holders 8 of the knives 7 are tiltable in the respective grooves 6 of the carrier 1. To this end, the peripheral surface of the carrier 1 is formed with a narrow circumferentially extending recess 12 which receives discrete pivot members 13, one for each knife 7. Each pivot member 13 is a bifurcated component having two prongs **13*a* which flank and can be rigidly connected to the central portion of the respective knife holder 8. One of the prongs 13*a* is indicated in the drawing by broken lines. The inner side or surface 14 of the wedge-like central portion of the pivot member 13 slopes with reference to the axis of the shaft 4 and abuts against a complementary cam face 16 provided on an axially movable wedge-like centrally located cam portion of a knife-displacing and adjusting member 18 forming part of an adjusting device 23. The apparatus which is shown in the drawing comprises a discrete adjusting device 23 for each of the knives 7. The displacing member 18 is shiftable in parallelism with the axis of the shaft 4 by a moving means here shown as an adjusting screw 19 which can be locked in a selected position by a lock nut 22 and whose external threads mesh with internal threads provided in a tapped bore which is machined into the right-hand end face of the corresponding displacing member 18. The latter is biased in a direction to the right, as viewed in the drawing, by a coil spring 17 which is inserted into the leftmost portion of the respective passage 1*a* provided in the knife carrier 1 for the displacing member 18. The adjusting screw 19 is rotatably mounted in an annular collar or flange 21 forming part of a sleeve 32 surrounding and having an end portion extending axially beyond a smaller-diameter extension or stub 4*a* of the shaft 4. The coil spring 17 ensures that the displacing member 18 moves in a direction to the right when the screw 19 is rotated in one direction, and the spring 17 is caused to store energy when the screw 19 is rotated in the opposite direction so as to move the displacing member 18 to the left, as viewed in the drawing, whereby the cam face 16 causes the corresponding pivot member 13 to move radially outwardly and to shift the corresponding knife 7** nearer to the peripheral surface of the rotary counterknife 2. The pivot member 13 can move radially inwardly, namely, nearer to the axis of the shaft 4, when the displacing member 18 is moved in a direction to the right, as viewed in the drawing, so that the coil spring 17 can dissipate some energy. Pivotability of each knife 7 is desirable because this ensures that the entire cutting edge 11 of each blade 9 can engage the peripheral surface of the counterknife 2 when the severing apparatus is in actual use. The ends of the guide grooves 6 in the knife carrier 1 are closed by ring-shaped covers 24 which are secured to the knife carrier by annuli of screws 26 or analogous fasteners. The collar 21 is adjacent to the right-hand end face of the knife carrier 1.

Each end face of each holder 8 is formed with an axially parallel blind bore 27 for reception of a coil spring 28 and a spherical element 29 a portion of which extends into a shallow recess machined into the internal surface of the respective ring-shaped cover 24. The bottom surfaces 31 of aligned recesses in the internal surfaces of the two ring-shaped covers 24 taper toward each other in a direction radially of and away from the axis of the shaft 4. The spherical elements 29 in the blind bores 27 of each holder 8 bear against the respective inclined bottom surfaces 31 under the action of the associated coil springs 28. The purpose of the spherical elements 29 is to maintain the holders 8 in such angular positions with reference to the corresponding pivot members 13 that the cutting edges 11 of the corresponding blades 9 are exactly parallel with the axis of the counterknife 2 but that the angular positions of the holders 8 can change (by allowing the holders 8 to pivot with reference to the corresponding pivot members 13 against the opposition of the coil springs 28) if the cutting edges 11 are not exactly parallel with the adjacent portions of the peripheral surface of the counterknife 2. In other words, the coil springs 28 and the spherical elements 29 cooperate with the inclined bottom surfaces 31 to permit for angular adjustments of each holder 8 at the onset of a severing operation. However, once the angular positions of the holders 8 are properly selected, so that the corresponding cutting edges 11 are exactly parallel with the axis of the counterknife 2, the coil springs 28 retain such holders in the adjusted positions. The bias of the springs 28 is sufficiently strong to prevent any changes in the inclination of the holders 8 under the action of centrifugal force, i.e., the angular positions of the holders 8 will be changed only if the cutting edges 11 of the respective blades 9 are not exactly parallel with adjacent portions of the peripheral surface of the counterknife 2.

The aforementioned sleeve 32 forms part of a support for the adjusting devices 23, and such support forms part of an additional adjusting device 43 which is common to all of the knives 7. The sleeve 32 is surrounded by a first antifriction ball bearing 33, which is installed in the frame member 3, and by a second antifriction ball bearing 36 which is installed in a block-shaped locating member 34 serving to hold the knife carrier 1 and the counterknife 2 against radial movement relative to one another. Reference may be had to the aforementioned commonly owned German patent application.

The sleeve 32 is shiftable axially of the stub 4*a* by a an externally threaded rotary member here shown as a screw 41 which has an externally threaded shank including a portion 38 in mesh with a lid 37 forming part of the aforementioned support and secured to the right-hand end portion of the sleeve 32 by one or more screws 32*a* or analogous fasteners. The lid 37 is adjacent to the right-hand end face of the stub 4*a* which latter is provided with a centrally located tapped blind bore for the externally threaded end portion 42 of the shank 41 of the shifting screw 41. The screw 41 can be releasably held in a selected angular position by a lock nut 39 which then bears against the right-hand end face of the lid 37. The direction of inclination of the threads on the portions 38 and 42 of the shank of the screw 41 is the same; however, the lead of each of these threads is different. For example, the thread on the portion 38 may be of the type M $10\times0.75$, and the thread on the end portion 42 may be of the type M $12\times1$. When such threads are used, one revolution of the shifting screw 41 brings about a relative axial movement between the sleeve 32 and the shaft 4 through a distance of 0.25 mm. The sleeve 32 thereby moves all of the individual knife adjusting devices 23 in parallelism with the axis of the shaft 4 and causes all of the members 18 to displace the associated pivot members 13 through identical distances, namely, radially of the shaft 4. In other words, the common adjusting device 43 can effect simultaneous shifting of the members 18 in parallelism with the axis of the shaft 4, and each adjusting device 23 can effect individual displacements of the respective displacing members 18 in parallelism with the axis of the shaft 4.

An important advantage of the improved severing apparatus is that each of the knives 7 can be adjusted independently of the other knife or knives 7. However, the common adjusting device 43 enables the operator to simultaneously adjust all of the knives 7 through identical increments which normally suffices to ensure accurate positioning of the cutting edges 11 with reference to the counterknife 2 (i.e., to ensure that the cutting edges 11 bear with requisite pressure against the periphery of the member 2 when the adjustment through the medium of the device 43 is completed, for example, after an 8-hour shift). Individual adjustments of the knives 7 are desirable and normally necessary when a fresh knife is inserted into the corresponding groove 6. Simultaneous adjustment of all of the knives 7 is advisable and is sufficiently accurate if it is carried out after a certain period of use of the severing apparatus. In other words, the individual adjusting devices 23 allow for accurate positioning of a freshly inserted or reinserted knife 7 in the corresponding groove 6, whereas the device 43 compensates for uniform or substantially uniform wear upon the cutting edges 11 of all knives 7 after a certain period of use. It has been found that, if the knives 7 are properly positioned in their grooves 6 as a result of accurate adjustment with assistance from the corresponding devices 23, the wear upon the cutting edges 11 is at least substantially uniform while the apparatus is in actual use.

Another important advantage of the improved apparatus is that the adjustments can be carried without necessitating even partial dismantling or removal of the severing apparatus from the machine, such as a filter tipping machine. The dismantling is indispensible in connection with conventional severing apparatus which merely embody adjusting features for individual knives. Accurate adjustment of each knife after a certain period of wear, for example, after each shift, can be achieved only if a conventional severing apparatus is removed from the machine frame and is tested in a suitable instrument, such as shown in FIG. 8 of the aforementioned U.S. Pat. No. 3,340,757 to Rudszinat. The common adjusting device 43 of the improved apparatus obviates the need for removal of the apparatus from the machine frame after completion of each shift or at other intervals. It has also been found that the improved severing apparatus can be used with particular advantage when the distance between the axes of the carrier 1 and counterknife 2 is fixed, i.e., if the apparatus is installed in a machine frame 3 comprising one or more locating blocks of the type shown at 34. The utilization of locating blocks for the carrier 1 and counterknife 2 is especially desirable and advantageous in modern high-speed tobacco processing machines which are designed to turn out many thousands of rod-shaped articles per minute. The main purpose of the locating blocks 34 is to reduce the noise in such rapidly operated machines. The reasons for such reduction in noise are fully disclosed in the commonly owned U.S. patent application Ser. No. 385,257 filed June 4, 1982 by Schlisio et al.

Another important advantage of the improved apparatus is its compactness. This is attributable to the feature that the sleeve-like element 32 of the common adjusting device 43 constitutes a support or retainer for the individual adjusting devices 23. As explained above, the individual adjusting devices 23 are mounted on the flange or collar 21 of the sleeve-like element 32.

The provision of the aforediscussed threads on the portions 38 and 42 of the shank of the shifting screw 41, and the mutual inclination of such threads, ensure a highly accurate adjustment of all knives 7 in response to rotation of the screw 41.

The improved severing apparatus can be utilized in existing filter tipping or analogous machines as a superior substitute for conventional severing apparatus. Furthermore, the improved apparatus can be used with equal or similar advantage in many other types of machines wherein a continuous web (for example, an adhesive-coated web) is to be subdivided into shorter sections or bands of desired length. The tiltability and adjustability of knives 7 renders it possible to prevent excessive wear upon and scoring of the peripheral surface of, the counterknife 2 so that such part can be utilized for long intervals of time.

It will be readily appreciated that numerous modifications may be carried out in the improved apparatus without departing from the spirit of the invention. For example, the individual adjusting devices 23 can be modified in a number of ways, and the same holds true for the common adjusting device 43. All that counts is to ensure that the severing apparatus is provided with individual adjusting devices, one for each of the adjustable knives 7, and that the apparatus is further provided with a common adjusting device which can simultaneously adjust each and every knife so that such operation can be completed within a small fraction of the time which is required in a conventional severing apparatus. Furthermore, the common adjusting device 43 is preferably mounted in such a way that it is readily accessible to an attendant at the outer side of the machine frame so that the attendant can gain access to the shifting screw 41 or to an analogous shifting element preparatory to simultaneous adjustment of all cutting implements.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for subdividing a running web, particularly a web of tipping paper in a filter tipping machine, into discrete sections, comprising a rotary knife carrier; a counterknife adjacent to and defining with said carrier a path for the running web substantially at right angles to the axis of the carrier; a plurality of adjustable knives on said carrier; a discrete first adjusting device for each of said knives, each of said first adjusting devices including means for adjusting the respective knife substantially radially of said carrier; and an adjusting device common to said knives and including means for simultaneously moving all of said knives substantially radially of said carrier.

2. The apparatus of claim 1, wherein said counterknife is rotatable about an axis which is spaced from the axis of said carrier.

3. The apparatus of claim 1, wherein said carrier comprises substantially radially extending guide means movably receiving said knives.

4. The apparatus of claim 1, wherein said common adjusting device comprises a support for all of said first adjusting devices.

5. The apparatus of claim 4, wherein said support constitutes a component of said means for simultaneously moving all of said knives.

6. The apparatus of claim 1, wherein each of said first adjusting devices comprises a knife-displacing member having a cam engaging the respective knife and means for moving said displacing member in parallelism with the axis of said carrier to thereby move the respective knife radially of said carrier through the medium of said cam.

7. The apparatus of claim 6, wherein said common adjusting device comprises a support for the displacing members and for the moving means of all of said first adjusting devices.

8. The apparatus of claim 7, wherein said moving means include screws meshing with the respective displacing members and rotatably mounted in said support.

9. The apparatus of claim 8, wherein said displacing members include substantially wedge-like portions constituting the respective cams.

10. The apparatus of claim 7, wherein said carrier has an end face and said support includes an annulus which is adjacent to said end face.

11. The apparatus of claim 7, wherein said common adjusting device further comprises means for moving said support and said first adjusting devices axially of said carrier.

12. The apparatus of claim 11, wherein said carrier comprises a shaft and said support surrounds and is movable axially of said shaft.

13. The apparatus of claim 12, wherein said support includes a collar supporting said first adjusting devices, a sleeve surrounding said shaft and rigid with said collar, said sleeve having an end portion extending beyond said shaft and said support further comprising a lid on the end portion of said sleeve, said means for moving said support including an externally threaded rotary member engaging said lid and meshing with said shaft.

14. The apparatus of claim 13, wherein the axis of said externally threaded member is parallel to the axis of said shaft.

15. The apparatus of claim 14, wherein said externally threaded member has a first thread meshing with said shaft and a different second thread meshing with said lid so that said lid moves with reference to said shaft in response to rotation of said externally threaded member with reference to said shaft.

16. The apparatus of claim 15, wherein the lead of said first thread deviates from the lead of said second thread.

17. The apparatus of claim 1, further comprising locating means for holding said carrier and said counterknife against movement relative to each other radially of said carrier.

* * * * *